United States Patent [19]

Crosslen

[11] 4,005,775

[45] Feb. 1, 1977

[54] DISPLAY CASE FOR USE WITH A MERCHANDISE DISPLAY RACK

[75] Inventor: Louis John Crosslen, Grafton, Wis.

[73] Assignee: Frank Mayer & Associates, Inc., Grafton, Wis.

[22] Filed: Feb. 24, 1976

[21] Appl. No.: 660,867

[52] U.S. Cl. ..... 206/45.18; 206/566; 206/45.14; 206/45/34

[51] Int. Cl.[2] ..... B65D 5/50; B65D 1/34

[58] Field of Search ..... 206/45.14–45.19, 206/75, 45.34

[56] References Cited

UNITED STATES PATENTS

| | | | |
|---|---|---|---|
| 1,906,111 | 4/1933 | Shields | 206/75 |
| 1,944,714 | 1/1934 | Lehmann | 206/75 |
| 2,178,652 | 11/1939 | Shields | 206/75 |
| 2,219,212 | 10/1940 | Sundee | 206/75 |
| 2,925,907 | 2/1960 | Grieve et al. | 206/75 |

*Primary Examiner*—William Price
*Assistant Examiner*—Douglas B. Farrow
*Attorney, Agent, or Firm*—James E. Nilles

[57] ABSTRACT

A display case and a merchandise display rack for supporting a plurality of such display cases around its circumference in a radial relationship. The merchandise display rack includes a plurality of relatively movable support members provided with cooperating spindles which are adapted to support the display cases and adapted to be simultaneously locked against displacement by a common locking mechanism to prevent unauthorized removal of the display cases. The display cases are trapezoidal in shape so that they can be received around the circumference of the display rack in radial relationship and each display case includes spaced aligned bores for receiving the spindles of the merchandise display rack. The display cases may be used to support a wristwatch therein and include a one piece base for supporting the wristwatch and a transparent cover including means for engaging the base. The one piece base may be comprised of a bottom portion and a back portion joined by an integral hinge such that they are movable from an open position wherein the watch is readily accessible, to an angular position wherein the transparent cover can be secured into place. A cuff is integrally attached to the back portion and provides a means for supporting a watch. A latch, comprising an integral molded part of the bottom portion, is receivable within a complementary slot in the back portion to secure the respective portions in an angular relationship.

10 Claims, 9 Drawing Figures

DISPLAY CASE FOR USE WITH A MERCHANDISE DISPLAY RACK

BACKGROUND OF THE INVENTION

The present invention pertains to display type receptacles and more particularly to a display case for a watch which can be used in conjunction with a carrousel type merchandising display rack. Merchandise display racks of the type referred to are shown by way of example in U.S. Pat. No. 3,517,827, issued June 30, 1970 to Crosslen and U.S. Pat. No. 3,661,273, issued May 9, 1972 to Crosslen, both of these patents being assigned to an assignee in common with that of the present invention.

SUMMARY OF THE INVENTION

The present invention provides a display case which can be mounted on the peripheral edge of a carrousel type merchandise display rack in such a manner as to be pilfer proof.

The merchandise display rack, for use in supporting the display cases, can include a pair of vertically spaced circular support members which in turn include vertically opposed aligned spindles receivable within bores in the display cases and to support the display cases. The support members are relatively movable to permit removal of display cases supported by the spindles but are adapted to be locked against displacement to prevent unauthorized removal of the display cases.

The display cases are generally used to display items such as wristwatches and the like, and generally include a base portion for supporting such items and a transparent cover which includes means for engaging the base portion in snap-fit relationship. A plurality of display cases are designed to be received around the periphery of the merchandise display rack, and in order to accommodate such positioning, each of the display cases is shaped to have a trapezoidal cross-sectional configuration. More specifically, each of the display cases has a truncated wedge shape such that when the display cases are positioned around the circumference of the generally cylindrical display rack, the display cases can be positioned in closely spaced adjacent relationship with the adjacent sides of adjacent display cases being substantially parallel.

An advantage of the display cases is that both the transparent removable cover and the base portion include aligned bores for receiving the spindles of the merchandise display rack. The display cases are thus supported in the merchandise display rack in such a manner that the cover cannot be removed from the base portion while the display cases are supported by the merchandise display rack.

One embodiment of the display cases of the present invention can include a one piece molded base portion which includes a bottom portion and a back portion integrally joined by a thin web or hinge member. The bottom portion and back portion can be hingedly movable from an open or linear position to an angular closed position. The back portion supports an integrally attached mounting cuff provided to support a wristwatch or the like. A projecting latch member is integrally connected to the bottom portion and receivable in a slot in the back portion to releasably secure the back and bottom portions in the angular position previously referred to.

A particular advantage of such a wristwatch display case is that it can be used in its open position during the latter stages of manufacture of the watch to support the watch and to thereby facilitage inspection of the watch or manufacturing steps. Since the watch display case can be maintained in this open position, the watch is more readily accessible and more easily handled. Following a completion of the manufacturing and inspection processes, the watch display case, containing a watch therein, can be closed or folded into its angular position and the transparent cover snapped into place in secured engagement.

DESCRIPTION OF THE PREFERRED EMBODIMENT

Figure 1:
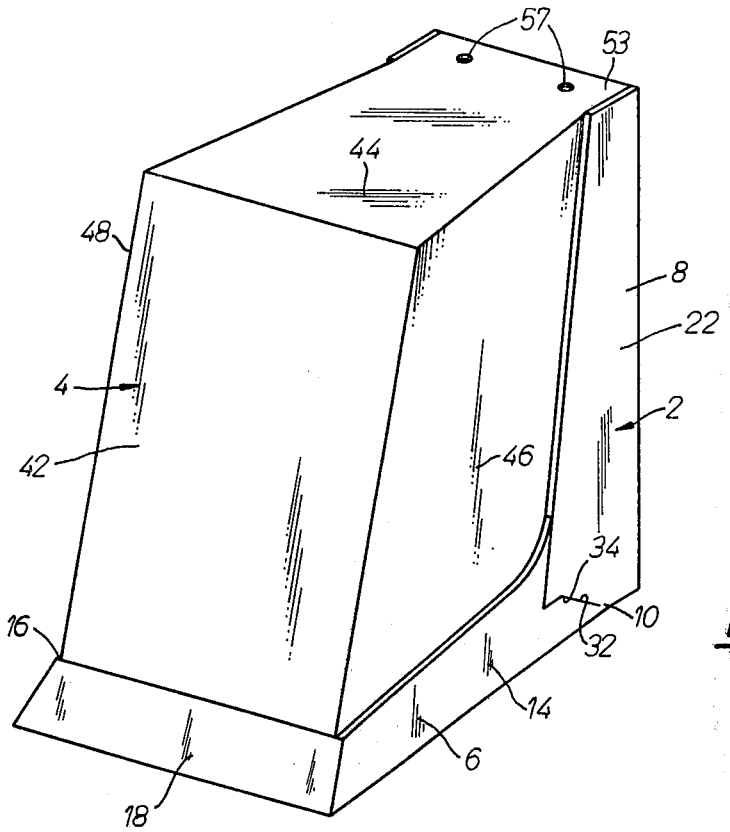
FIG. 1 is a perspective view of the wristwatch display case of the present invention.

FIG. 1 illustrates a wristwatch display case of the present invention which includes a base portion 2 designed to support a wristwatch or the like and a transparent plastic removable cover 4 which is shaped to be received over a watch supported by the base 2 and to be secured in a snap-fit relationship with the base 2.

Figure 2:
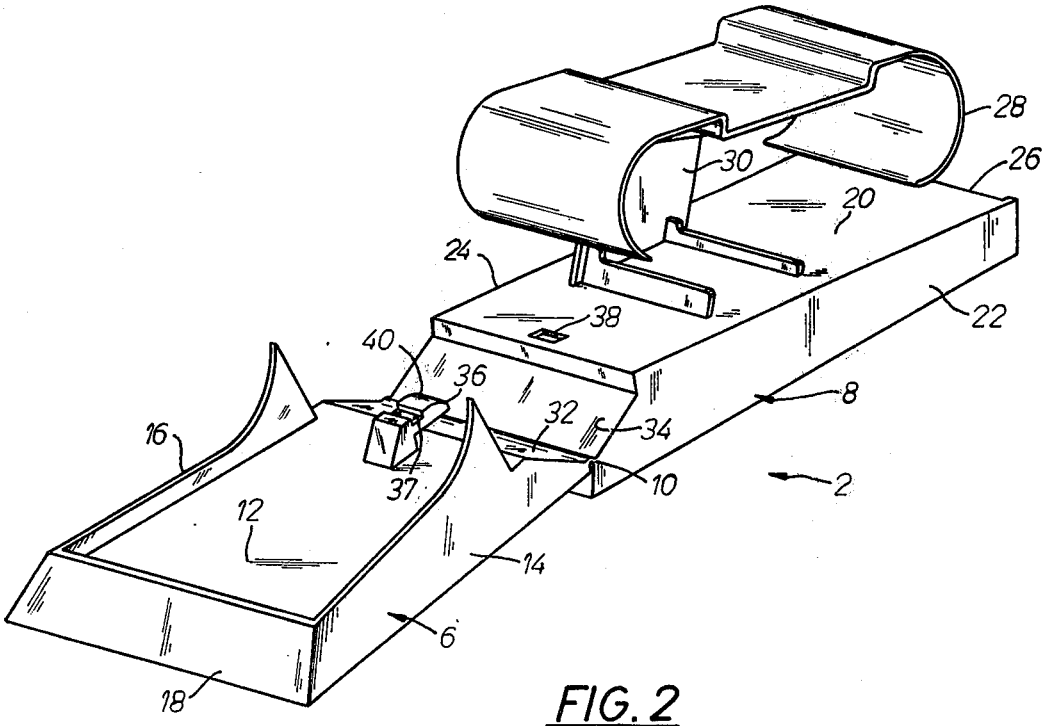
FIG. 2 is a perspective view of the base of the wristwatch display case shown in FIG. 1 and shown in an open position.
Figure 3:
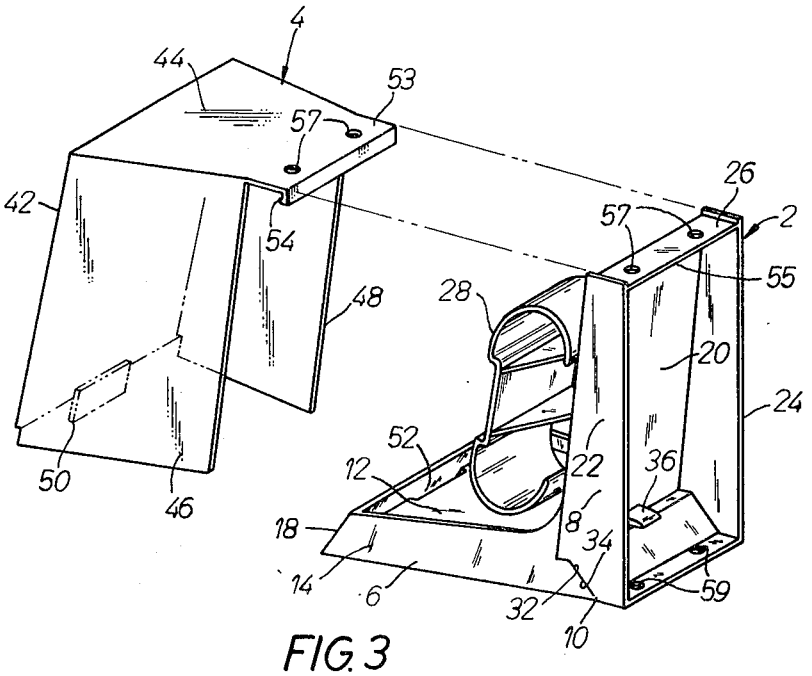
FIG. 3 is an exploded rear perspective view in a reduced scale of the wristwatch display case shown in FIG. 1.
Figure 4:
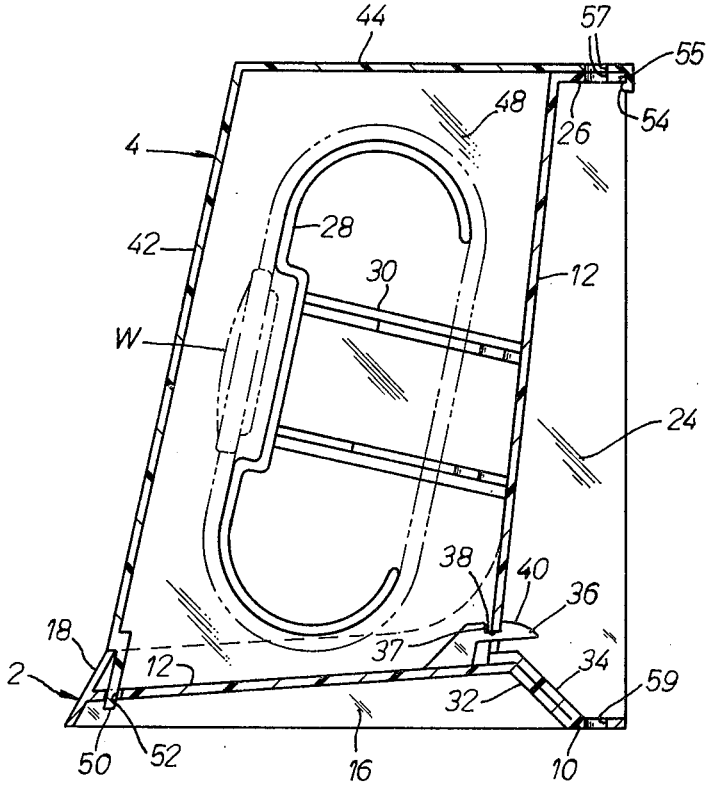
FIG. 4 is a cross-sectional side elevation view of the wristwatch display case shown in FIG. 1.

FIGS. 2–4 illustrate more clearly the structure of the base 2. The base 2 is a one piece molded article generally comprised of a bottom portion 6 and a back portion 8 which are integrally joined by a living hinge 10 comprised of a thin web of flexible plastic material. The bottom portion 6 is comprised of a generally flat upwardly and rearwardly sloping floor 12 supported by side walls 14 and 16 and by a front wall 18. The back portion 8 includes a back wall 20, side walls 22 and 24 and an upper end wall 26. The back wall 20 supports an integral mounting cuff 28. The mounting cuff 28 comprises a generally rigid oblong band designed to support a wristwatch W in the manner illustrated in FIG. 4. The mounting cuff 28 is in turn supported by a bracket 30 which is integrally connected to both the mounting cuff 28 and the back wall 20. As best shown in FIG. 4, the bottom portion 6 and the back portion 8 include angular walls 32 and 34, respectively, which are joined by the living hinge 10 and which are received in adjacent parallel relationship when the bottom portion and back portion are positioned in the angular relationship shown in FIG. 4.

The bottom portion 6 also includes a projecting latch member 36 which extends upwardly from the upper surface of the floor 12 and projects rearwardly toward the back portion 8. The latch portion 36 includes a notch 37 in its upper surface and is designed to be received within a complementary slot 38 in the lower portion of the wall 20 of the back portion 8, as shown in FIG. 4 and in such a manner that the upper edge of slot 38 is received in notch 37. The latch portion 36 includes a camming surface 40 such that when the bottom and back portions of the base 2 are moved from the position shown in FIG. 2 to the position shown in FIG. 4, the latch 36 can be received through the bore 38 and lock the base in an angular position.

A particularly desirable feature of the wristwatch display case of the present invention lies in the fact that the case may be opened such that it extends relatively linearly as shown in FIG. 2 and then closed to assume the angular position shown in FIGS. 3 and 4. During the manufacture of a watch and after the assembly of the watch, the watch may be placed on the cuff 28 with the base 2 in the open position, as shown in FIG. 2. By having the base in the open position, it is easier to position the watch on the mounting cuff 28. Furthermore, by leaving the watch case in the open position during any subsequent manufacturing or assembling processes, the watch is more readily accessible and the bottom portion 6 does not encumber further manual operations or inspection.

At the completion of the manufacturing process, the bottom portion 6 and the back portion 8 can be moved to the angular position shown in FIGS. 3 and 4 and locked into this position by the latch 36 and the bore 38. The transparent removable cover can then be placed over the watch. The transparent removable cover 4 includes a front wall 42, a top wall 44, and a pair of side walls 46 and 48. The front wall 42 includes a downwardly projecting tab 50 at its lower edge which is aligned with and receivable with a slot 52 in the floor 12 of the bottom portion 6 of the base 2. The upper wall 44 of the transparent removable cover 4, is shown as having a rearwardly projecting flange 53 in turn having a downwardly projecting lip 54 which can releasably engage the rearward edge 55 of the upper wall 26 of the back portion 8. The transparent removable cover 4 can thus be releasably secured to the base 2.

Both the rearwardly projecting flange 53 of the upper wall 44 of the transparent removable cover 4 and the wall 26 of the back portion 8 include a pair of vertically extending horizontally spaced bores 57. The lower portion of the back portion 8 also includes a pair of horizontally spaced bores 59. The bores 57 and 59 are vertically aligned and are each designed to receive opposed and aligned vertical projections extending from support members of a merchandise display rack as shown in FIG. 5 and as will be described.

Figure 5:
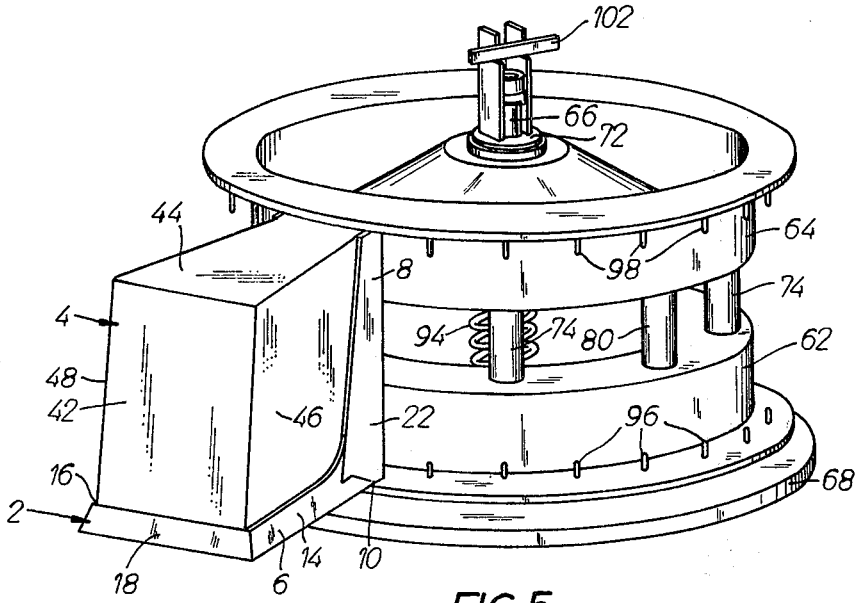
FIG. 5 is a perspective view of a merchandising display unit supporting the wristwatch display case shown in FIG. 1 and in accordance with the invention mounted thereon.
Figure 6:
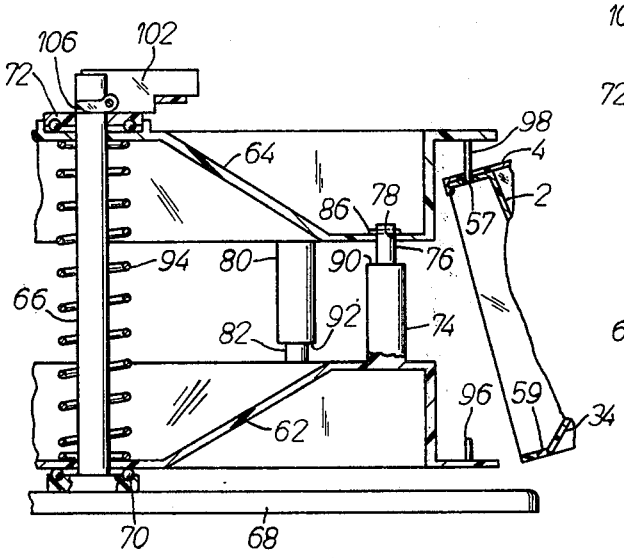
FIG. 6 is a vertical cross-section view of a portion of the merchandising display unit of FIG. 5 showing the relatively shiftable support members of the unit moved to open position to enable attachment or detachment of the display case.
Figure 7:
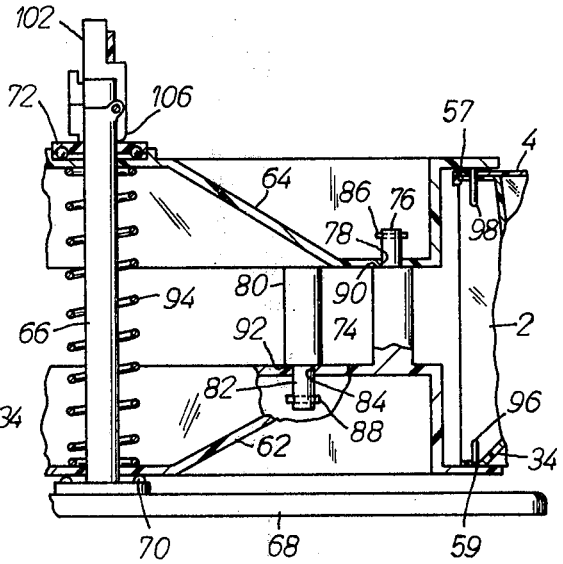
FIG. 7 is a view similar to FIG. 6 but showing the relatively shiftable support members in closed position to secure the wristwatch display case thereon in locked condition.

The display rack shown in FIGS. 5–7 for use to support the watch display cases of the present invention includes a pair of vertically and axially spaced support members 62 and 64 shown as being of disc shape and each having a central aperture for reception on an upright shaft 66. The shaft 66 is secured to and extends upwardly from a suitable base 68.

The support members 62 and 64 are preferably rotatably received on the shaft 66, and for this purpose, suitable anti-friction bearings 70 and 72 may be provided below the lower support member 62 and above the upper support member 64, respectively. Each pair of support members 62 and 64 are also spaced axially from each other a minimum predetermined distance while being relatively axially movable to such predetermined distance. For this purpose as well as to key the members 62 and 64 of each set together and thereby prevent relative rotational movement thereof, the support member 62 is provided with an annular series of spaced upwardly directed spacer and guide posts 74, each having a reduced diameter end portion 76 slideably received in an aligned aperture 78 in the other support member 64, and the support member 64 is formed with a similar annular series of alternately spaced downwardly directed spacer and guide posts 80, each also having a reduced diameter end portion 82 slideably received in an aligned aperture 84 in the support member 62.

Axial displacement of the support members 62 and 64 is prevented by means of pins 86 and 88 which are positioned adjacent the ends of the reduced diameter portions 76 and 82. These pins 86 and 88 cooperate with shoulders 90 and 92 of the respective posts 74 and 80 to permit limited relative axial movement of the support members 62 and 64 within predetermined limits. The support members 62 and 64 are resiliently urged apart by means of a spring 94.

Each of the support members 62 and 64 includes an annular series of equally spaced and axially aligned vertical projections or spindle shafts 96 and 98, respectively, for supporting the wristwatch display cases therebetween. As shown, the spindle shafts 96 project upwardly from the lower support member 62 toward the aligned downwardly projecting spindle shafts 98 of the upper support member 64. The upper spindle shafts 98 are somewhat longer than the lower spindle shafts 96 to thereby prevent free displacement of the wristwatch display cases whenever the support members 62 and 64 are spread apart. The spindle shafts 96 and 98 do permit removal of the watch display cases, however, when the support members 62 and 64 are spread apart to their fullest extent in the manner shown in FIG. 6 wherein the watch display case has been moved upwardly off of the spindle shafts 96 and pulled outwardly and then lowered to free it from the upper spindle shafts 98.

In order to lock the support members 62 and 64 in their closest position, as shown in FIG. 7, a cam lever 102 is provided at the end of the shaft 66 and above the upper support member 64. This cam lever 102 may be pivotably secured to the shaft 66, and includes a cam surface 106 co-acting with the upper bearing 72 to compress the spring 94 and move the members 62 and 64 axially toward each other when moved to the position shown in FIG. 7. As shown in FIG. 7, when the support members 62 and 64 are in this position, they closely engage the upper and lower surface of the watch display case and the spindle shafts 96 and 98 received within the spaced bores 57 and 59 of the watch display case, preventing removal of the watch display case from the display rack. It should be noted that the upper spindle shafts 98 and the support member 64 also prevent removal of the cover 4 thereby prohibiting access to a watch within the watch case.

Figure 8:
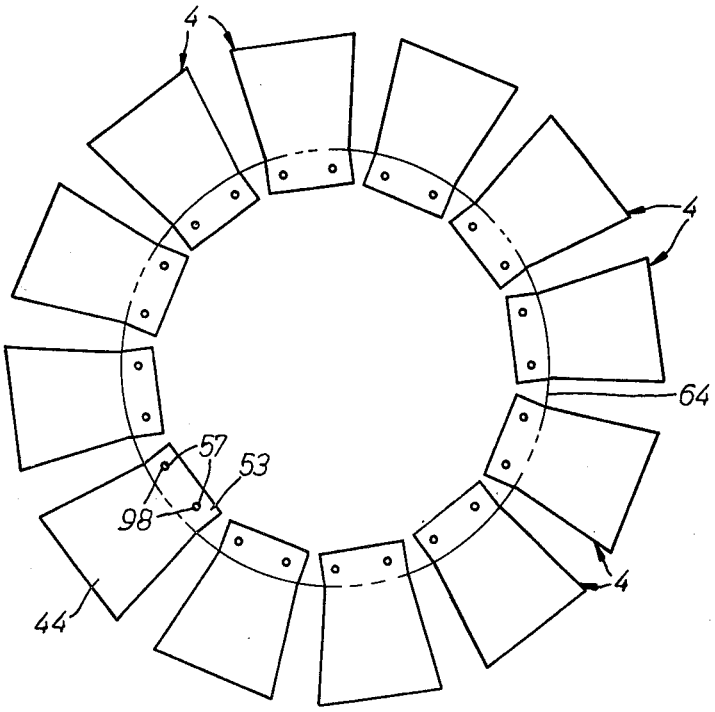
FIG. 8 is a schematic plan view of the merchandising display unit shown in FIG. 5 and supporting a plurality of wristwatch display units around its periphery.

FIG. 5 illustrates only one wristwatch display case held by the display rack, however, as shown in FIG. 8, a plurality of such display cases are to be disposed around the entire circumference of the display rack and extending radially outwardly from the display rack. In order to provide for attachment of a plurality of such watch display cases around the periphery of a carrousel type merchandise display rack such as that shown, the wristwatch display cases each include a narrow rear side adjacent to the merchandise display rack and a wider front side away from the display rack. The display cases thus have a trapezoidal cross-sectional configuration and the lateral side walls of the display cases are generally parallel to adjacent lateral side walls of adjacent display cases.

Figure 9:
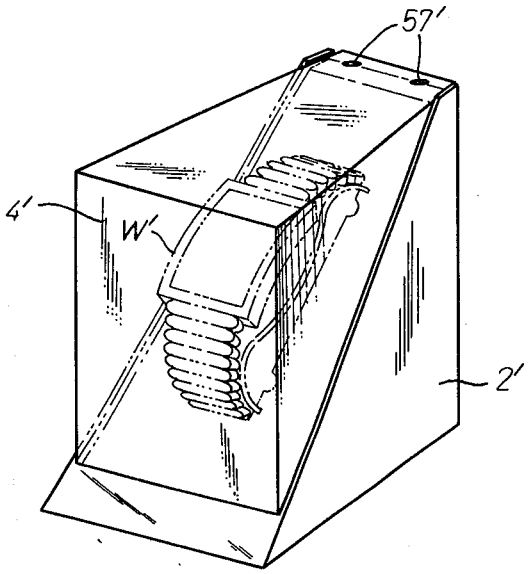
FIG. 9 is a perspective view of an alternative embodiment of a wristwatch display case which can be used in combination with the merchandising display unit shown in FIGS. 5–7.

FIG. 9 illustrates an alternative embodiment of a wristwatch display case which can be used with the merchandise display rack shown in FIGS. 5–8 and supported therefrom in the same manner as the wristwatch display case previously described. The display case shown in FIG. 9 includes a one piece base portion 2' for supporting a wristwatch W'. A removable transparent cover 4' cooperates with the base portion 2' to enclose the watch W'. The removable cover 4' and the base portion 2' can be closed in snap-fit relationship and include aligned horizontally spaced bores 57' such that the display case can be supported from the merchandise display rack as shown in FIGS. 5–8.

I claim:

1. A wristwatch display case comprising: a molded one piece base and a removable cover, said one piece base including a bottom portion, a back portion, a mounting cuff attached to one of said portions and for supporting a wristwatch thereon, a hinge integrally connected to said bottom portion and to said back portion and hingedly connecting said portions for movement between an open position wherein said portions are substantially coplanar, whereby a wristwatch supported on said mounting cuff is readily accessible, and an angular display position wherein said portions are substantially transverse, and means on said base and cover enabling said base and cover to be releaseably secured together.

2. The wristwatch display case set forth in claim 1 wherein said hinge comprises a flexible molded web extending between said bottom portion and said back portion.

3. The wristwatch display case set forth in claim 1 wherein said one piece base includes a latch integrally connected to one of said portions, and a slot in the other of said portions for receiving an end of said latch in releaseably secured engagement whereby said bottom and back portions are secured in said angular position.

4. The wristwatch display case set forth in claim 1 wherein said removable cover includes a projecting tab engageable with said bottom portion and includes a lip having a projecting edge for releaseably engaging said back portion whereby said removable cover and said molded one piece base can be releaseably secured together.

5. The wristwatch display case set forth in claim 1 wherein said mounting cuff is integrally attached to said back portion.

6. The wristwatch display case set forth in claim 1 wherein said removable cover includes a front wall, a pair of spaced opposed adjacent side walls and a top wall, each of said walls being transparent.

7. A wristwatch display case for use with a merchandise display rack having a pair of spaced support members, said support members each having projecting means for engaging said display case, said wristwatch display case comprising: a molded one piece base and a transparent removable cover, said one piece base including a bottom portion, a back portion, a mounting cuff supported by said back portion for supporting a wristwatch thereon, a hinge connected to said bottom portion and to said back portion to integrally hingedly connect said portions for movement between an open position and an angular position, said open position facilitating access to said wristwatch, a latch integrally connected to one of said portions, and a slot in the other of said portions engageable with said latch to secure said bottom and back portions in said angular position.

8. The wristwatch display case set forth in claim 7 wherein said hinge comprises a flexible molded web extending between said bottom portion and said back portion.

9. The wristwatch display case set forth in claim 7 wherein said transparent removable cover further includes a projecting tab engageable with said bottom portion and a projecting flange releaseably engageable with said back portion whereby said transparent removable cover can engage said base in removably secured relationship.

10. The wristwatch display case set forth in claim 7 wherein said one piece base and said transparent removable cover include aligned bores when said transparent removable cover engages said base in removably secured relationship, said bores receiving said projecting means whereby said display case is restricted against removal from said merchandise display rack.

* * * * *